United States Patent [19]

Winquist

[11] Patent Number: 4,546,924

[45] Date of Patent: Oct. 15, 1985

[54] FUEL INJECTOR

[75] Inventor: Knut L. Winquist, San Antonio, Tex.

[73] Assignee: Southwest Research Institute, San Antonio, Tex.

[21] Appl. No.: 554,968

[22] Filed: Nov. 25, 1983

[51] Int. Cl.[4] ..... F02M 45/00

[52] U.S. Cl. ..... 239/533.4

[58] Field of Search ..... 239/533.2–533.12, 239/569, 581, 582; 137/119; 251/63.4, 229

[56] References Cited

U.S. PATENT DOCUMENTS

| | | | |
|---|---|---|---|
| 1,786,844 | 12/1930 | Hesselman . | |
| 2,358,494 | 9/1944 | Haines . | |
| 3,442,456 | 5/1969 | Thompson et al. . | |
| 3,620,456 | 11/1971 | Berg . | |
| 3,777,984 | 12/1973 | Greathouse . | |
| 3,924,652 | 12/1975 | Kah, Jr. | 137/119 |
| 4,109,670 | 8/1978 | Slagel | 137/119 |
| 4,202,500 | 5/1980 | Keiczek | 239/533.3 |
| 4,225,088 | 9/1980 | Kulke et al. . | |
| 4,315,603 | 2/1982 | Nakajima et al. . | |
| 4,356,977 | 11/1982 | Hofmann . | |

FOREIGN PATENT DOCUMENTS

| | | | |
|---|---|---|---|
| 2079369 | 1/1982 | United Kingdom | 239/533.9 |

OTHER PUBLICATIONS

K. L. Hulsing, Automotive Engineering, 1979, pp. 61–62.

*Primary Examiner*—Andres Kashnikow
*Assistant Examiner*—Daniel R. Edelbrock
*Attorney, Agent, or Firm*—Vaden, Eickenroht, Thompson & Jamison

[57] ABSTRACT

There are disclosed several embodiments of a fuel injector for injecting fuel into the combustion chamber of an internal combustion engine in response to the pressure of the fuel. In each embodiment, a nozzle of the injector which extends into the combustion chamber is opened and closed by means of a valve member which is yieldably urged into tight engagement with a seat in the lower end of the nozzle and which is rotated in response to increasing and decreasing fuel pressure, respectively, to move the outlets in the valve member and nozzle into and out of register.

21 Claims, 25 Drawing Figures

Fig. 4A-B

FUEL INJECTOR

This invention relates generally to a fuel injector for an internal combustion engine; and, more particularly, to an improved injector of the type in which fuel is injected into the combustion chamber of the engine in response to the pressure of the fuel.

As illustrated and described on pages 59–62 of the publication AUTOMOTIVE ENGINEERING, November 1979, conventional fuel injectors of this type comprise a hollow nozzle having orifices in its lower end leading to the combustion chamber, and a valve member which is reciprocable longitudinally within the nozzle to form an annular passageway between them. Fuel is supplied from an inlet to a cavity in the body of the injector above the nozzle, and a conically shaped lower end of the valve member is spring-pressed against a similarly shaped seat in the lower end of the nozzle so as to close the passageway and thus close the injector. A portion of the valve member is responsive to pressure of fuel in the cavity of the injector body to urge the valve member away from the seat and thus connect the passageway with the orifices to open the injector when fuel pressure reaches a sufficiently high level to overcome the force of the spring.

As also illustrated and described in the aforementioned publication, the orifices may be formed in the seat of the nozzle or in a sac or chamber in the lower end of the nozzle beneath the seat. In both cases, however, the valve member must be moved a substantial distance before the area between its lower end and the nozzle seat equals that of the fixed orifices. Thus throttling of the fuel flow through the passage between the valve member and the seat during the periods of valve opening and closing, reduces the fuel pressure at the orifices, which in turn impairs atomization of the fuel spray and causes incomplete combustion. The problem is especially acute upon closing of the injector because at this stage a high cylinder pressure will slow the closing of the injector valve thereby increasing the quantity of poorly atomized fuel that enters the combustion chamber at the end of an injection event. This fuel has not sufficient time for burning and contributes to exhaust pollutants.

As further illustrated and described in the aforementioned publication, it has been proposed to alleviate at least certain of these problems by the use of a so-called variable orifice injector having a cylindrical plunger which reciprocates axially within a hollow, open-ended nozzle. The plunger is hollow and has an open upper end to receive fuel from the fuel inlet, and has outlets through its lower end so arranged that spray orifices formed by said outlets and the sharp edge of the lower, open end of the nozzle will increase or decrease as the plunger moves towards or away from the combustion chamber. More particularly, the plunger is spring-pressed away from the combustion chamber, and has a portion which is responsive to the pressure of the fuel to urge it toward the combustion chamber so that the injector is opened when the force due to fuel pressure overcomes that due to the spring.

One advantage to this latter type injector, as compared with those previously described, is that there is no throttling of the fuel upstream of the orifices. Also, the orifices are not opened until the plunger has been moved a distance which permits the fuel pressure to build up to a desired level, and the fuel pressure may be maintained at a higher level when the injector is closing than when it is at opening, because gas pressure in the combustion chamber assists closing movement of the plunger. Still further, the orifices may be arranged in series spaced longitudinally of the plunger so as to permit staged injection—i.e., an initial pilot injection followed by a main injection.

However, although this type of injector should result in higher fuel pressure at the orifices, and thus better atomization of the fuel spray, the clearance required to permit the plunger to reciprocate relatively freely within the nozzle allows fuel to leak past the plunger both prior to opening and following closing of the injector. Thus, leakage will occur as soon as fuel pressure exceeds gas pressure within the combustion chamber, prior to the injection event, and will continue after the injection event until it drops below the gas pressure. Still further, when the orifices are arranged in series to provide stage injection, unwanted fuel injection inherently occurs upon return movement of the plunger in closing the injector.

The primary object of this invention is to provide an injector having variable orifices which, due to fuel pressure, may be opened or closed quickly in order to admit or shut off the fuel flow from the injector at a fuel pressure that is not reduced by valve restrictions upstream the orifices and thereby reduce problems which result from low fuel pressure injection pressure, but which does not permit fuel to leak into the combustion chamber prior to or following the injection event.

A further object is to provide such an injector in which the maximum orifice size may be easily and quickly adjusted, and in which the speed at which the injector moves toward opened and closed positions may be controlled, each independently of the other.

Still another object is to provide such an injector in which the fuel is sprayed in stages, but without unwanted fuel injection during return of the injector to closed position.

These and other objects are accomplished, in accordance with the illustrated embodiments of the invention, by an injector of the type described in which, as in certain of the conventional injectors above described, a valve member extends longitudinally within a hollow nozzle and has a lower end which is spring-pressed into engagement with a seat in the lower end of the nozzle having a number of outlets formed therein to connect with a combustion chamber. However, as compared with such prior injectors, the valve member, which is hollow so as to receive fuel from the inlet to the body cavity and has outlets in its end, is rotatable about its longitudinal axis, in response to increasing and decreasing fuel pressure, so as to move the outlets in its end respectively into and out of register with those in the nozzle in response to the rise and fall of fuel pressure. Thus, as compared with such prior injectors, the valve member need not be moved toward and away from the nozzle seat to close and open the injector, and thus the fuel pressure at the spray orifices of the injector is not reduced by the earlier described throttling and therefore can be maintained high enough to ensure a sufficiently good atomization of the fuel from the beginning to the end of an injection event. Still further, because the valve member is spring-pressed into engagement with the seat of the nozzle body, such fuel leakage between the plunger-valve and the nozzle as occurs in the above described plunger type injector is prevented.

In the preferred and illustrated embodiments of the invention, the valve member has means thereon which urges its end surface away from the seat in the nozzle, in response to fuel pressure, and thereby counteracts at least a portion of the force with which such surface is urged against the seat so as to lessen the friction between them. Also, a means for stopping rotation of the valve member is adjustable so the valve member may be stopped in any position where its outlets are in part or in full register with those of the nozzle body so as to form orifices of any size that may be desired.

As illustrated, the means for so rotating the valve member comprises a control member which is mounted within the cavity of the injector body for longitudinal movement with respect thereto, and which has means thereon for urging it in one longitudinal direction away from the combustion chamber, and thus away from the nozzle seat in response to fuel pressure in the cavity of the injector body. More particularly, a means is provided for yieldably urging the control member in the opposite longitudinal direction—i.e., toward the nozzle seat—and the control member and valve member are connected by means which rotates the valve member from a position in which the outlets of the valve member and the nozzle body are out of register to a position in which the said outlets are in register, upon movement of the control member in the one longitudinal direction in response to rising fuel pressure in the cavity, and from a position in which the outlets of the valve member and the nozzle body are in register to a position in which they are out of register, upon movement of the control member in the other longitudinal direction in response to decreasing fuel pressure in the cavity. Preferably, and as illustrated in each embodiment of the invention, the control member comprises a sleeve which surrounds the valve member for longitudinal movement with respect to it, and one of the valve member and control sleeve has a slot therein and the other of said valve member and control sleeve has a pin slidable in the slot, with the slot being arranged to rotate the valve member from the first-mentioned position to the second-mentioned position, as fuel pressure rises, and from the second-mentioned position to the first-mentioned position as fuel pressure decreases.

In one embodiment of the invention, the slot is of such width that the control member is free to move a short distance in the one longitudinal direction, prior to its connection to the valve member for rotating it to open position, and a corresponding distance in the other longitudinal direction, prior to its connection to the valve member for rotating it to closed position. Hence, a certain build up of the fuel pressure is permitted in order to move the control member from its bottom position to the position of engagement of the pin and the slot of the valve member and the control member. In this position the control member is temporarily stopped because of counteracting forces, mainly the friction between the valve member and the seat of the nozzle body. However, as earlier described, the valve member has means thereon which is responsive to the fuel pressure so as to urge the valve member to open position. As a result, the transmission of force from the control member to the valve member is reduced to an acceptable level as the control member due to rising fuel pressure resumes moving and rotates the valve member from closed to open position. This rotation occurs by a snap action because the counteracting friction force changes from static value to the lesser kinetic value as the valve member starts rotating. In a similar way to that of the opening, the valve closing also occurs with a snap action, as the control member, due to decreasing fuel pressure, returns and is again temporarily stopped following engagement of the pin and the slot permitting the fuel pressure to decrease and then rotate the valve member to closed position by snap action.

In another embodiment of the invention, the means which connects the control member and valve member is arranged to rotate the valve member at successively different rates per unit of longitudinal movement of the control member, and, more particularly, to rotate the valve member at one rate until the outlets of the valve member and nozzle first move into register, and then at a different rate as said outlets move into full register. In the preferred and illustrated embodiment of the invention, the valve member is initially rotated at a relatively fast rate until said outlets of the valve member and nozzle first move into register and then at a relatively slower rate as they continue to move into full register. As illustrated, this controlled rate of rotation of the valve member is accomplished by a slot having portions which extend at different angles with respect to the longitudinal axis of the injector body and thus the longitudinal axis of movement of both the valve member and the control sleeve.

In the above-described embodiment of the invention, a spring-pressed means is also provided for temporarily stopping rotation of the valve member in a position where its outlets are moved toward the outlets of the nozzle but not into register, and then, as pressure continues to build up, permitting continued rotation of the valve member. The first part of the rotation of the valve member may occur quickly at a relatively low fuel pressure while the second part may occur at a much higher fuel pressure and at a predetermined slower speed. As a result the outlets of valve member and nozzle may be moved into or out of register in such relation to the increasing or decreasing fuel pressure as to form orifices of a size that is correspondingly increased or decreased during an injection event. In this manner it is possible to obtain a fine atomization from the beginning to the very end of an injection event. Upon return movement of the valve member, removal of the force due to the spring-pressed stopping means enables the valve member to be moved quickly to orifice closing position while fuel pressure is still relatively high.

In still another embodiment of the invention, the valve member and the nozzle have radially inner and outer sets of outlets which are so arranged that one set moves into and out of register prior to the other set, thereby enabling stage injection. In this embodiment, the above-described means for temporarily stopping rotation of the valve member is so arranged as to stop it as the first set of outlets of the valve member and nozzle are moved into register, and thus during pilot injection, and, when fuel pressure builds up, permit continued rotation thereof to move the other set into register during the main injection. Preferably, the connecting means between the valve member and the control sleeve comprises a slot and pin which are so constructed and arranged that the first set of orifices are opened only as the valve member moves toward open position and remain closed as the valve member moves toward closed position. In this manner it is possible to obtain a pilot injection that is followed by the main injection and a later unwanted injection is prevented.

In the drawings, wherein like reference characters are used throughout to designate like parts:

FIG. 1 is a longitudinal sectional view of the first-described embodiment of an injector constructed in accordance with the present invention, mounted on the head of an internal combustion engine so as to dispose the lower end of the nozzle thereof within the combustion chamber of a cylinder of the engine, and with the valve member in a rotative position with respect to the nozzle in which the outlets of the valve member are out of register with the outlets of the nozzle so as to close the injector;

Figure 1:
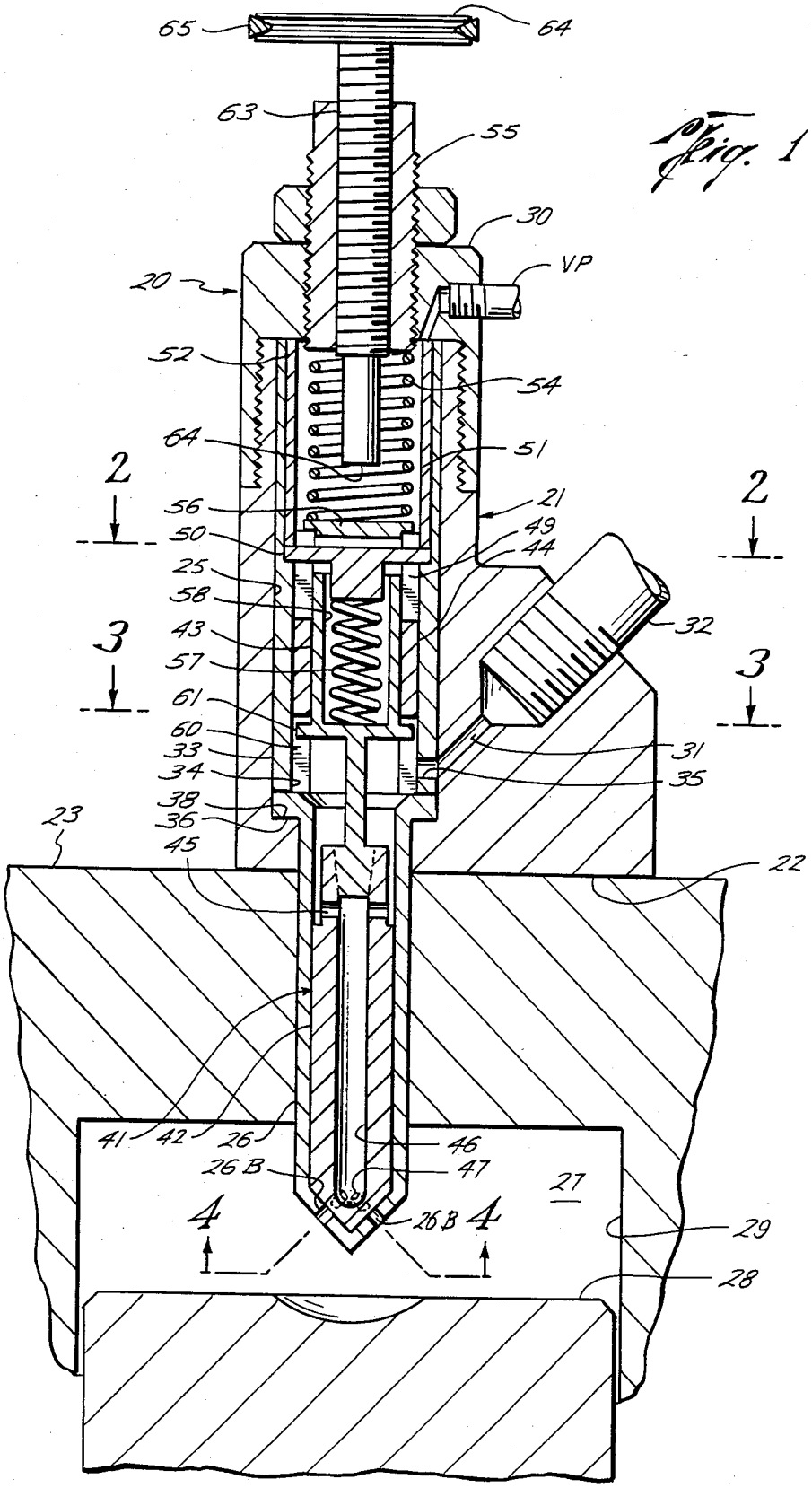
FIG. 1A is a longitudinal sectional view of an inner portion of the injector of FIG. 1, removed from its outer body, and with the control member thereof raised in response to increasing fuel pressure so as to rotate the valve member into a position in which the outlets have begun to register with the outlets of the nozzle so as to form orifices.
FIG. 1B is a further longitudinal view of the inner portion of the injector shown in FIG. 1A, but upon upward movement of the control member to further rotate the outlets in the lower end of the valve member into full register with those in the nozzle.
Figure 1A:
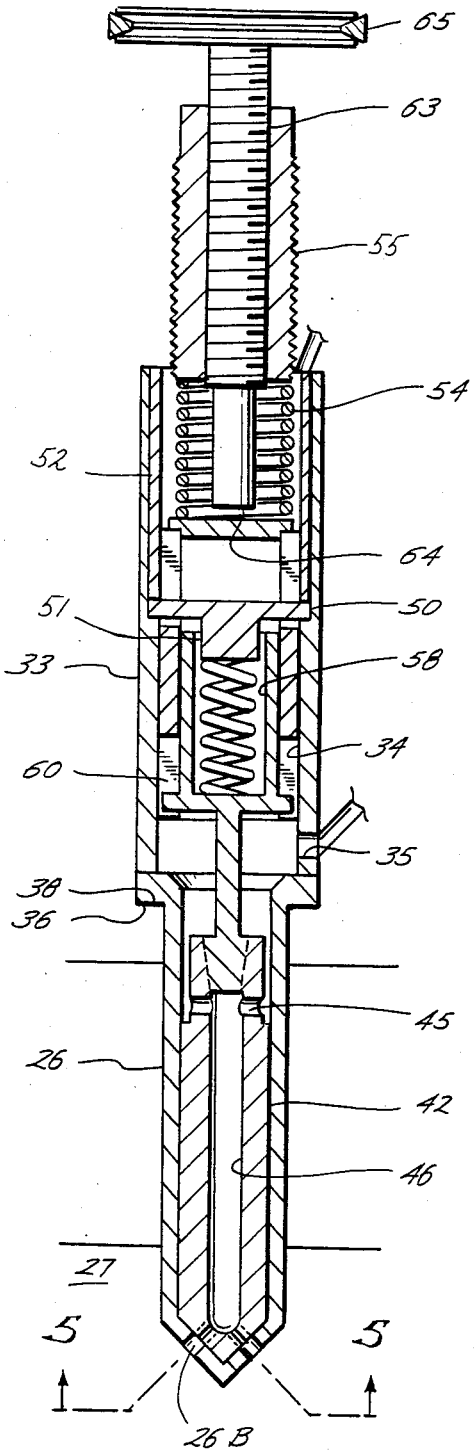
Figure 1B:
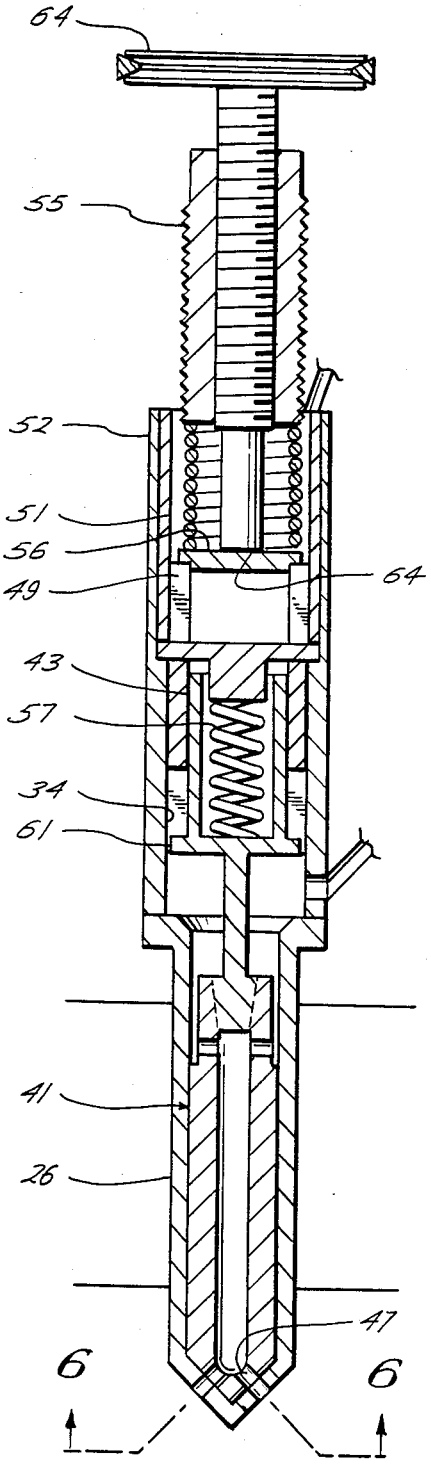
Figure 2:
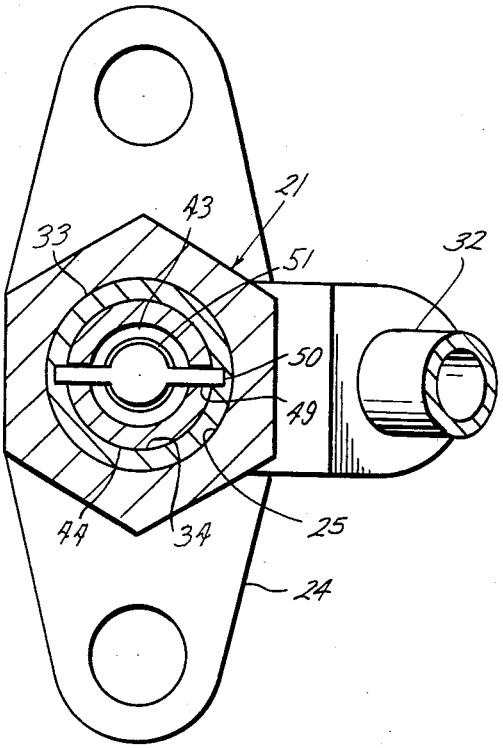
Figure 3:
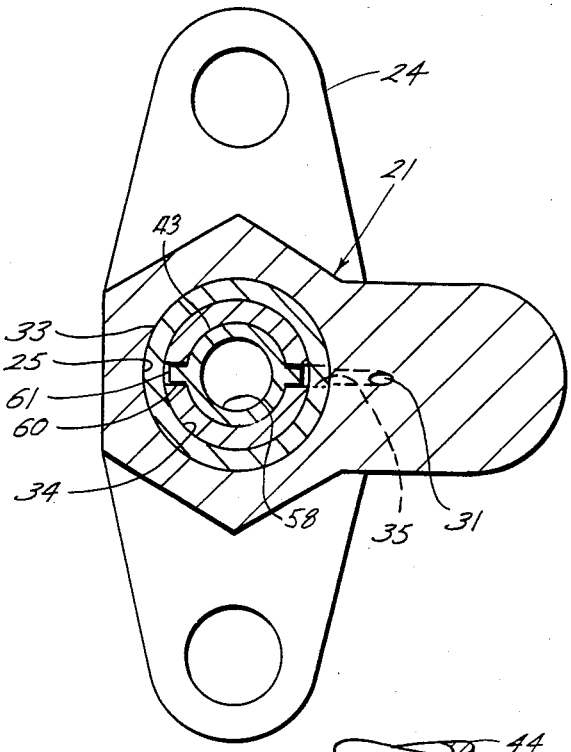
Figure 4:
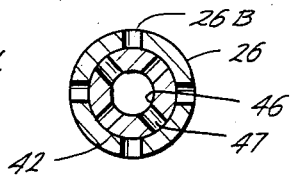
Figure 4A:
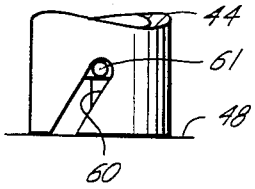
Figure 4A:
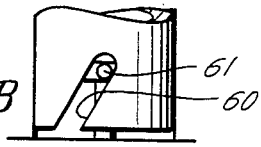
Figure 5:
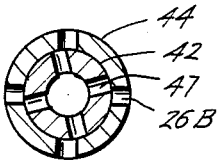
Figure 4B:
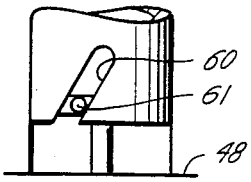
Figure 6:
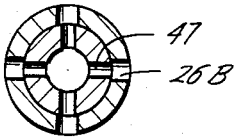
Figure 4C:
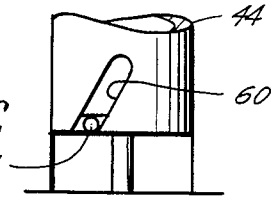
Figure 7:
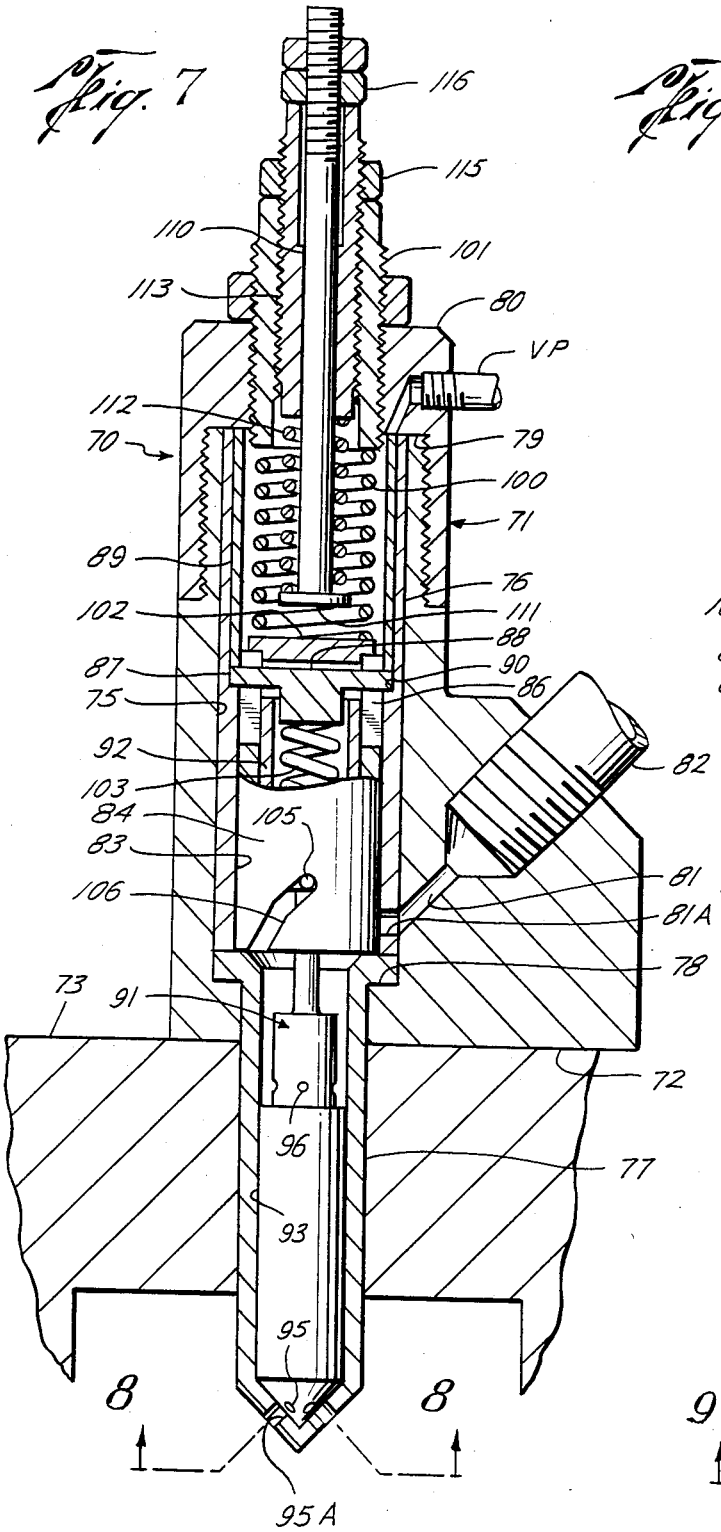
Figure 7A:
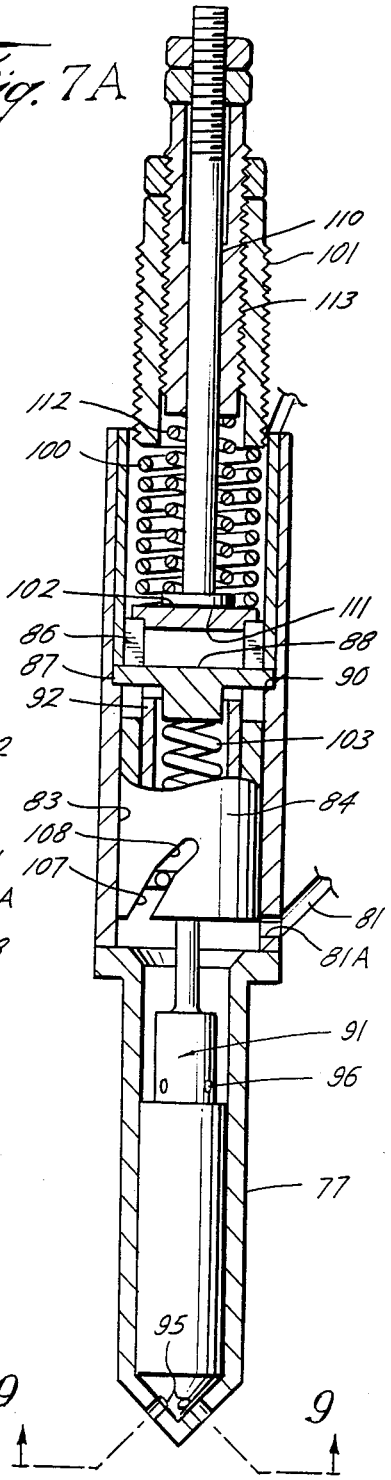
Figure 8:
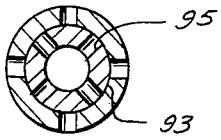
Figure 9:
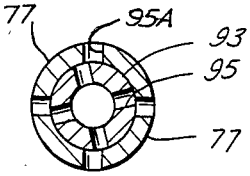
Figure 7B:
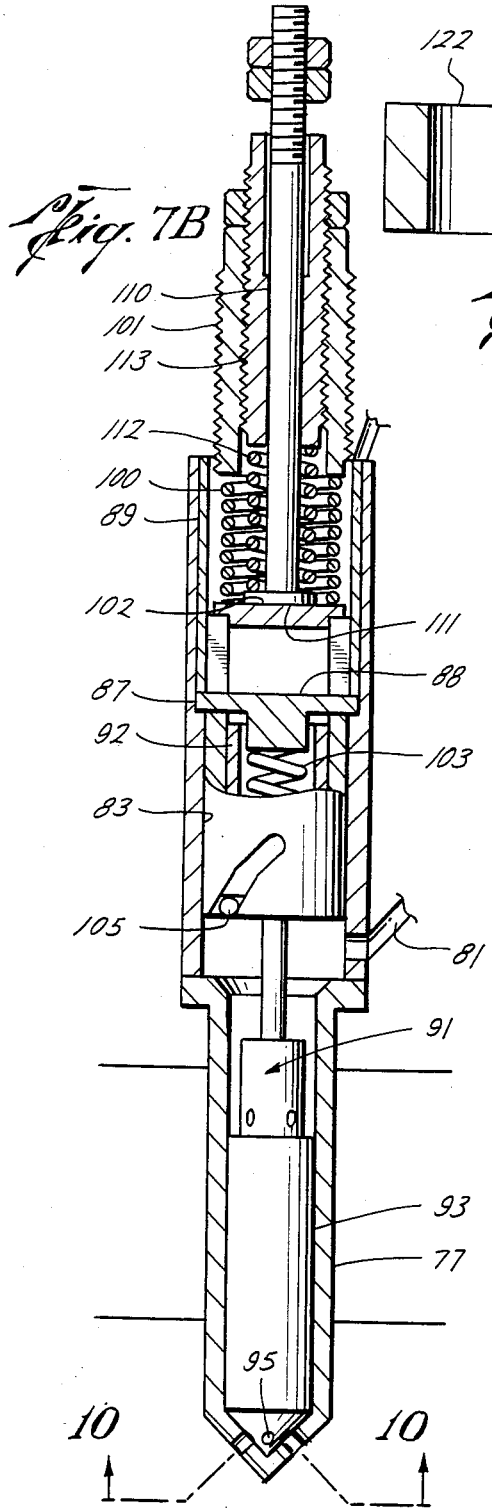
Figure 11:
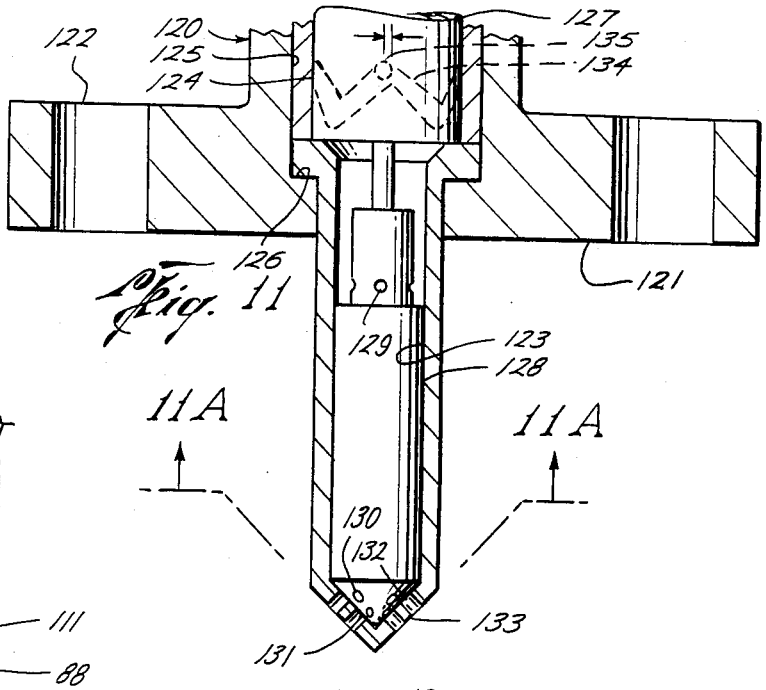
Figure 13:
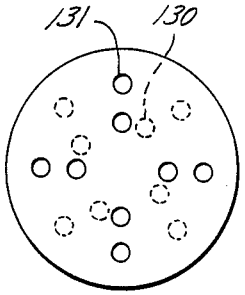
Figure 12:
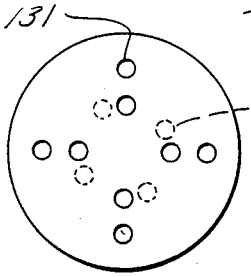
Figure 11A:
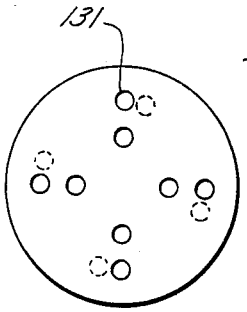
Figure 10:
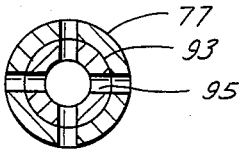
Figures 14, 15, 16:
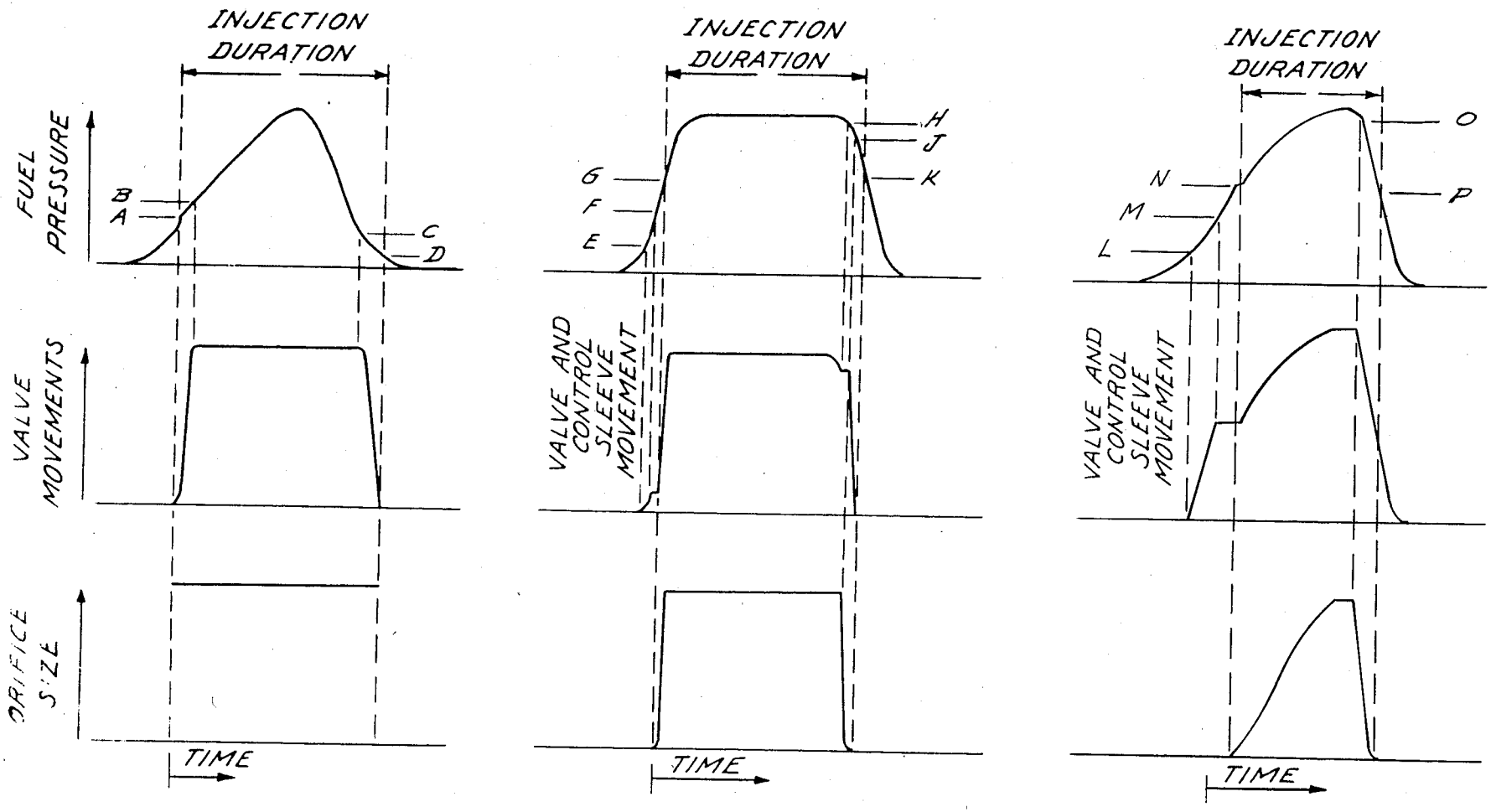

FIGS. 2 and 3 are cross-sectional views of the injector of FIG. 1, as seen along broken lines 2—2 and 3—3 thereof, respectively;

FIG. 4 is a sectional view through the lower ends of the nozzle and valve member of the injector, as seen along broken lines 4—4 of FIG. 1, and illustrating the relative positions of the outlets thereof when out of register;

FIG. 5 is another sectional view similar to FIG. 4, and as seen along broken lines 5—5 of FIG. 1A, to illustrate the relative positions of the outlets of valve member and nozzle body as they first begin to move into register with one another and orifices are beginning to be formed by said outlets;

FIG. 6 is a still further sectional view similar to FIGS. 4 and 5, and as seen along broken lines 6—6 of FIG. 1B, to illustrate the relative positions of the outlets of the valve member and nozzle body when they are brought into full register and full sized orifices are formed;

FIG. 4A is an elevational view of the side of a portion of the control sleeve and valve member of the injector, in their relative positions shown in FIG. 1, and thus with the outlets out of register, as shown in FIG. 4;

FIG. 4AB is a view similar to FIG. 4A, but upon initial upward movement of the control sleeve with respect to the valve member, in response to increasing fuel pressure, so as to engage the lower side of the slot with the pin on the valve member, but with the outlets still out of register;

FIG. 4B is a view similar to FIGS. 4A and 4AB, but with the control sleeve moved further upwardly to the position of FIG. 1A to rotate the valve member to a position in which the outlets therein just begin to move into register with the outlets in the nozzle, as shown in FIG. 5;

FIG. 4C is another elevational view similar to FIG. 4B, but with the control sleeve lifted a still further distance to the position of FIG. 1B to further rotate the valve member to a position in which the outlets therein are in full register with those of the nozzle, as shown in FIG. 6;

FIG. 7 is a vertical sectional view of an injector constructed in accordance with the second-described embodiment of the present invention, similarly mounted on the head of an internal combustion engine so as to dispose the lower end of its nozzle in the combustion of a cylinder in the head, and with the valve member thereof shown in a rotative position in which its outlets are out of register with those in the nozzle so as to close the injector, the lower portion of the control sleeve being shown in elevation so as to illustrate the location of a pin on the valve member within an upper portion of a slot in the control sleeve;

FIG. 7A is a view of an inner portion of the injector of FIG. 7 removed from the outer body thereof, and showing the control sleeve raised with respect to the valve member, in response to increasing fuel pressure, so as to rotate the valve member into a position in which the outlets in its lower end just begin to move into register with the outlets in the lower end of the nozzle;

FIG. 7B is another longitudinal sectional view of the inner portion of the injector of FIG. 7, similar to FIG. 7A, but upon continued upward movement of the control sleeve to further rotate the valve member into a position in which its outlets are in full register with those of the nozzle;

FIG.8 is a sectional view of the lower end of the valve member nozzle, as seen along broken lines 8—8 of FIG. 7, and showing the relative positions of the outlets in the valve member and nozzle when the injector is closed;

FIG. 9 is a sectional view of the nozzle, similar to FIG. 8, and taken along broken lines 9—9 of FIG. 7A, so as to show the relative positions of the outlets as they first begin to move into register;

FIG. 10. is still another sectional view of the nozzle, similar to FIGS. 8 and 9, and as seen along broken lines 10—10 of FIG. 7B, so as to show the relative positions of the outlets when they have been moved into full register;

FIG. 11 is a view, partially in longitudinal section and partially in elevation, of the lower end of an injector constructed in accordance with the last-described embodiment of the invention, and wherein the valve member thereof is in a rotative position in which inner and outer sets of outlets are out of register to close the injector;

FIG. 11A is an enlarged view of the lower end of the nozzle, as seen along broken lines 11A—11A of FIG. 11, and showing the valve member rotated to a position in which the inner sets of outlets of the valve member are in register with the inner sets of outlets in the nozzle but in which the outer sets are out of register;

FIG. 12 is another view of the lower end of the injector of FIG. 11, similar to FIG. 11A, but upon raising of the control sleeve in response to increasing fuel pressure so as to rotate the valve member into a position in which the outer sets of the outlets are in register and the inner sets of the outlets are out of register;

FIG. 13 is still another enlarged view of the lower end of the nozzle, similar to FIGS. 11A and 12, but upon further lifting of the control member to further rotate the valve member into a position in which the outer sets of outlets are also out of register so as to close the injector, as in FIG. 11;

FIG. 14 is a diagrammatic illustration of fuel pressure, valve member movement and orifice size during a typical injection event of an injector constructed in accordance with a prior art injector;

FIG. 15. is a diagrammatic illustration of fuel pressure, control sleeve and valve member movement, and orifice size of an injector constructed in accordance with the first-described embodiment of the present invention; and FIG. 16 is another diagrammatic illustration of similar parameters of an injector constructed in accordance with the second-described embodiment of the invention.

With reference now to the details of the above-described drawings, the first-described embodiment of the invention, which is indicated in its entirety by reference character 20, is shown in FIG. 1 to include an outer body 21 having a lower side 22 mounted on the head 23 of an internal combustion engine by means of bolted flanges 24 or the like. The injector also includes an inner portion which fits closely within a bore 25 in the outer body, and which is removable therefrom, as shown in Figs. 1A and 1B, upon removal of a cap 30 threadedly connected to the open, upper end of the remainder of the outer body. When in place, as shown in FIG. 1, the cap bears on the upper end of the inner portion of the injector to hold an annular shoulder 36 thereon down against a seat 38 at the lower end of the bore 25.

The inner portion of the injector body includes an upper tubular member 33 which fits closely within bore 25, and a hollow nozzle 26 which extends from the lower end of member 33 through a hole in the head to dispose its lower end within a combustion chamber 27 above a piston 28 in a cylinder 29 of the head 23 of the engine. The lower end of member 33 is held down on a flange at the upper end of the nozzle which is supported on the seat 38.

As shown in FIG. 1, fuel is supplied to the elongate cavity 34 formed within the member 33 and thus to the nozzle through an inlet connecting to the side of the injector body. Thus, an inlet tube 32 is threadedly connected to an enlarged outer portion of a port 31, and the inner end of the bore 31 connects with the cavity through a port 35 in the tubular member.

The injector also includes an elongate valve member 41 having a lower portion 42 which fits closely and guideably, within the nozzle 26 of the inner body, and an upper portion 43 which extends within the cavity of the injector body above the fuel inlet. The upper portion 43 of the valve member is surrounded by a control sleeve 44 which in turn fits closely and guidably within the cavity 34. As will be described to follow, the control sleeve is held against rotation, but is free to reciprocate axially and thus longitudinally of the injector body. The valve member, on the other hand, is free to rotate about its longitudinal axis, but is held down against longitudinal movement and with its lower end tightly engaged with a seat in the lower end of the nozzle. More particularly, and as described, the valve member and control sleeve are so connected as to rotate the valve member between positions opening and closing the injector in response to reciprocation of the control sleeve.

The intermediate portion of the valve member is reduced to provide space within the inner body cavity 35 through which fuel may flow freely from the inlet into ports 45 in the upper end of the lower portion 42 of the valve member which connect with an opening 46 extending longitudinally within the lower portion of the valve member. Outlets 47 are so formed in circumferentially spaced-apart relation through the closed lower end of the valve member so as to permit them to be moved into and out of register with circumferentially spaced-apart outlets 26B through a seat in the lower end of the nozzle as the valve member is rotated between alternate positions. As shown, the lower end of the valve member is conically shaped and conforms to the seat in the lower end of the nozzle so that, when its end is yieldably urged against the seat the injector is closed when the valve member is in a rotative position in which the outlets in the lower end thereof are out of the register with the nozzle outlets.

The upper portion of the control sleeve is provided with diametrically opposed slots 49 which fit closely over ears 50 extending from diametrically opposite sides of a head 51 and into the lower end of a counterbore in the upper end of the tubular member 33. The ears are in turn held down on a seat at the lower end of the counterbore by slots within the lower end of a sleeve 52 which is received with the counterbore and held down on the seat by the lower end of cap 30. Thus, the head 51 is held in a fixed rotational position so as to prevent rotation of the control sleeve 44 as the slots 49 move over the ears 50 during longitudinal movement of the control sleeve within the body cavity.

A coil spring 54 is disposed within the upper end of the body cavity between the lower side of a threaded sleeve 55 arranged centrally of the cap 30 and a plate 56 which is supported on the upper end of the control sleeve 44. More particularly, the spring 54 is held in compression so as to yieldably urge the control sleeve downwardly onto the flange on the upper end of nozzle 26 with a force which may be adjusted by manipulation of the threaded sleeve 55. Another coil spring 57 is disposed within a cavity 58 in the upper portion of the valve member between the lower side of the head 51 and the bottom of the cavity to urge the valve member downwardly with respect to the valve body with a force which maintains its lower end tightly engaged with the seat on the lower end of the nozzle 26.

The outer diameter of the control sleeve 44 is closely slidable within the cavity of the inner body so as to form a sliding seal therewith, and the inner diameter thereof is closely slidable over the outer diameter of the upper hollow portion 43 of the valve member so as to form a sliding seal between them as the sleeve moves longitudinally with respect to the valve member. Thus, the cross-sectional area of the sleeve as well as an area of the valve member within the inner diameter of the sleeve are responsive to and thus urged upwardly by means of fuel pressure. The outer diameter of the lower portion 42 of the valve member within the nozzle 26 is also responsive to fuel pressure, but is urged downwardly thereby. Since the cross-sectional area of the upper portion 43 is larger than that of the lower portion 42 of the valve member, the resultant force due to fuel pressure urges it in an upward direction. However, this force is less than that due to spring 57 so that the lower end of the valve member is held tightly against the seat in the nozzle.

A pair of diametrically opposed slots 60 extend upwardly from the lower end of the control sleeve 44, to receive pins 61 extending from diametrically opposite sides of the lower end of the upper portion 43 of the valve member. As shown in FIGS. 4A–4C, slot 60 extends at an angle with respect to the longitudinal axis of the valve member and sleeve so that, during upward movement of the control sleeve from the position of FIG. 4AB to the position of FIG. 4B, the valve member is caused to rotate in a clockwise direction, as seen looking down on its longitudinal axis. More particularly, as the control sleeve moves upwardly from the position of FIG. 4AB the outlets of the valve member begin to move into register with those in the nozzle, as shown in FIG. 5, and, as the control sleeve continues to rise from the position of FIG. 4B to that of FIG. 4C, the valve member is rotated a still further amount so as to bring its outlets into full register with those of the nozzle, as shown in FIG. 6. As shown in FIG. 1, a pipe VP vents the cavity above the control sleeve and valve member to prevent a fluid lock as the control sleeve rises and falls within the cavity.

Each slot 60 is wider than pin 61 which it receives and is so arranged that when the sleeve 44 is in its lowermost position, as shown in FIG. 4A, the pin 61 in the valve member is above the lower side of the slot. Thus, as can be seen from a comparison of FIGS. 4A and 4AB, the sleeve 44 is free to move upwardly a short distance before bringing the lower side of its slot into engagement with the pin 61 of the valve member, and thus connecting the valve member to the sleeve for rotation with it. Hence, as the control member is moved upwardly from the position of FIG. 4A in response to rising fuel pressure, it will be temporarily stopped at the position of FIG. 4AB because the fuel pressure is not sufficient to further overcome the resistance to rotation of the valve member due to the friction between its lower end and the seat of the nozzle, and to a lesser extent between the pins and slots. However, as earlier described, the valve member has an area over which fuel pressure acts to urge the valve member upwardly and thus, as the fuel pressure continues to rise, the resistance of the valve member to rotate is correspondingly reduced and, at a predetermined fuel pressure, the control member will continue to move upwardly and quickly rotate the valve member from the closed position of FIG. 1 to the open position of FIG. 1B.

The quick, almost instantaneous, valve opening is mainly due to the fact that static friction is larger than kinetic friction. More particularly, a larger force is needed for starting the valve member to rotate (also called the break loose force) than the force that is needed for its continued rotational sliding on the seat of the nozzle. Hence, when the valve member starts rotating the fuel pressure has already risen to a level which is high enough to move the control sleeve and rotate the valve member with a snap action from the closed to the open position of the injector. Of course, although the force by which the valve member is urged against the seat is reduced due to fuel pressure, it is still high enough to keep the valve member sealably against the seat even at maximum fuel pressure.

A rod 63 is threadedly received through the sleeve 55 of the cap 30 to dispose its lower end 64 in a position within the cavity of the valve body in which it will be engaged by the plate 56 on the upper end of the control sleeve as the control sleeve rises to rotate the valve member. As shown in the drawings, the rod 63 has been rotated to a position within the nut in which it will stop upward movement of the control sleeve as the valve member moves its outlets into full register with those of the nozzle. Obviously, however, the rod 63 may be lowered to engage the upper end of the control sleeve before the outlets of the valve member reach full registry with those in the nozzle. Hence, the rod 63 provides a means by which the maximum extent of registering of the outlets and thus the size of the formed orifices may be adjusted. As shown in FIG. 1, this means may include an externally manipulatable part such as a sheave 64 on the upper outer end of the rod and about which a belt 65 is disposed. This invention contemplates that the belt may in turn be mechanically connected to a means for automatically adjusting the vertical position of the lower end of the bolt 63 in response to some predetermined condition.

At the conclusion of the injection event, and in response to decreasing fuel pressure, the control sleeve 44 will of course be moved downwardly under the influence of the spring 54. When the sleeve is moved downwardly to the extent required to bring the top side of the slot 60 into engagement with the pin 61, its downward movement is again temporarily stopped due to the additional force required to overcome the static friction between the lower end of the valve member and the seat of the nozzle. However, upon continued lowering of the fuel pressure, with a resulting decrease on the upward force of the sleeve due to fuel pressure, the control sleeve will again begin to move downwardly under the influence of the spring 54 in order to rotate the valve member in a counterclockwise direction back toward closed position in which the outlets in the lower end of the valve member are out of register with those of the nozzle. As in the case of the rotation of the valve member toward injector opening position, this return movement of the valve member toward injector closing position will occur with a snap action and thus at a fast rate.

As previously described, the injector constructed in accordance with the second-described embodiment of the invention, and illustrated in its entirety by reference character 70 in FIG. 7, is similar in many respects to the injector 20. Thus, as shown in FIG. 1, it comprises an outer body 71 having a lower end 72 mounted on the head 73 of an internal combustion engine, as by means of bolted flanges, as described in connection with FIGS. 2 and 3. Also, the outer body 71 has a bore 75 therein having an enlarged upper diameter to receive the upper tubular member 76 of an inner body of the injector which is supported on a flange at the upper end of a hollow nozzle 77 of the inner body, and the nozzle extends through a hole in the head 73 to dispose its lower end of the nozzle within a combustion chamber of the engine above a piston in a cylinder thereof.

Tubular member 76 of the inner body of the injector is held down upon the flange of the nozzle by a cap 80 releasably connected to the open upper end of the remainder of the outer injector body, and the flange is supported on a shoulder 78 in the lower end of the enlarged upper diameter of bore 75. As in the case of injector 20, the cap may be removed to permit removal of the inner portion of the injector 70, as shown in FIGS. 7A and 7B. Still further, fuel enters an elongate cavity 83 in tubular member through a tube 82 connected to the outer body and leading to a bore 81 therein connecting with a port 81A in the tubular member and thus with cavity 83.

Injector 70 further includes a control sleeve 84 which fits closely within the cavity 83 in the tubular member to form a sliding seal therewith, and, in the lowermost portion of the control sleeve, as shown in Fig. 7, its lower end is supported upon the flange of the nozzle 77. The control sleeve is also held against rotation within the injector body in a manner similar to that by which the control sleeve of the injector 20 is so held. Thus, the upper end of the sleeve has diametrically opposed slots 86 which fit closely over ears 87 extending from diametrically opposite sides of a head 88 within the body cavity. The head and thus the ears 87 are held down against rotation by means of a sleeve 89 received within a counterbore in the upper end of the tubular member and having slots in its lower end fittable over the ears 87. The lower end of the sleeve is held down by cap 80 against shoulder 90 at the lower end of the counterbore.

As was also true of the injector 20, injector 70 includes a valve member 91 having an upper hollow portion 92 which is closely received within the inner diameter of the control sleeve to provide a sliding seal therewith upon longitudinal movement of the sleeve with respect to the valve member, and a lower portion 93 which is received closely within the hollow nozzle 77. Also, the lower end of the valve member conforms to the seat in the nozzle, and ports 96 are formed in a reduced diameterintermediate portion of the valve member to connect an opening (not shown) which extends longitudinally therein with its lower end which is held down on the nozzle seat, as in the injector 20. The lower end of cavity 83 connects with the annular space about the intermediate portion of the valve member to permit fuel to flow into ports 96.

As in the case of injector 20, the control sleeve 86 of the injector 70 is yieldably urged downwardly to the seated position of FIG. 7 by means of a coil spring 100 which is compressed between the lower end of a nut 101 extending threadedly through cap 80 and the upper side of a plate 102 seated upon the upper end of the control sleeve. Also, the valve member is yieldably urged downwardly to tightly engage its lower end with the seat in the nozzle by means of a coil spring 103 disposed between the head 88 and the lower closed end (not shown) of the upper hollow portion 92 of the valve member. As in the case of injector 20, circumferentially spaced-apart outlets 95 and 95A formed in both the lower end of the valve member and the nozzle seat are adapted to be moved into and out of register upon rotation of the valve member between the positions of FIGS. 7 and 7B. When the valve member is in the FIG. 7 position, the outlets are out of register and the tight engagement of the lower end of the valve member with the nozzle seat maintains the injector closed.

As in the injector 20, the valve member 91 is adapted to be rotated between injector opening and closing positions by means of pins 105 extending from diametrically opposite sides of the upper end of the valve member and received within slots 106 formed in opposite sides of the lower end of the control sleeve. Thus, as in the case of the injector 70, the control sleeve will rotate the valve member to open position as it moves upwardly in response to a predetermined fuel pressure acting upwardly over the cross-sectional area of the control sleeve, and will rotate the valve member back to injector closing position as the sleeve moves back downwardly to its lower position in response to decreasing fuel pressure. As was also true in the case of injector 20, the cross-sectional area of the upper portion 92 of the valve member is greater than that of the nozzle 93 (and thus the seating area of its lower end), so that there is a resultant upward force on the valve member due to fuel pressure, although this force is in any event less than the downward force of spring 103 so that the lower end of the valve member remains tightly engaged with the nozzle seat by a force that may be reduced to a predetermined level so as to facilitate opening and closing of the injector.

However, as compared with those of the injector 20, the pins 105 fit closely within the slots, and the slots have first and second portions 107 and 108 which extend at different angles with respect to the axis of reciprocation of the control member and valve member, whereby the valve member is caused to rotate at different rates per unit of longitudinal movement of the control sleeve. In the illustrated and preferred embodiment of the invention, the upper portion 108 of the slot extends at a larger angle with respect to the axis of reciprocation of the control sleeve so as to rotate the valve member at a relatively fast rate as the control sleeve first begins to move upwardly and then at a relatively slow rate as it moves to the open position of the injector. More particularly, the portions 107 and 108 of the slot and the outlets in the lower end of the valve member are so arranged that the outlets first begin to move into register with those in the nozzle (see FIG. 9) as the pins 105 move from the portion 108 to the portions 107 (see FIG. 7A), whereby the valve member will be rotated at a slower rate as the outlets move into full register, as shown in FIG. 7B. In like manner, of course, upon return of the valve member to injector closing position, it is initially rotated at a relatively slow rate until the outlets begin to move out of register with one another, as shown in FIG. 9, and then at a faster rate as they are moved to a position out of register with one another, as shown in FIG. 8. As in the injector 20, the valve member must move a short distance, as can be seen from a comparison of FIGS. 8 and 9, before the orifices begin to form as the outlets of valve member and nozzle body begin to register.

In the injector 70, a rod 110 extends slidably through the nut 101 in the cap 80 to dispose its lower end 111 in position to be engaged by the plate 102 on the upper end of the control sleeve as the control sleeve moves upwardly to rotate the valve member (see FIG. 7A). However, and as compared with the rod 63 of the injector 20, since the rod 110 is free to move upwardly within the nut, the control sleeve is free to continue to move upwardly until the lower ends of the slots 86 move into engagement with the lower sides of the pins 87 (see FIG. 7B ) and thus until the orifices of the injector are fully opened, as shown in FIG. 10. More particularly, a coil spring 112 is compressed between a flange on the lower end 111 of the rod 110 and the lower end of an inner nut 113 threadedly received within the nut 101 and through which the rod extends. Consequently, the lower end of the rod is yieldably urged downwardly with a force which will temporarily stop upward movement of the control sleeve until fuel pressure rises sufficiently to overcome the force due to the spring 112, and then permit it to move upwardly and the valve member to continue to rotate at a speed determined by the stiffness of the spring and the shape of the slots.

In this embodiment of the invention, the lower end 111 of the rod is preferably so located that it engages the upper end of the control sleeve as the control sleeve reaches a position in which the valve member is rotated to a position just before that in which its outlets begin to register with those of the nozzle. As a result, opening of the injector is temporarily delayed and the fuel pressure is permitted to build up to a level that is determined by the initial force by the spring 112. Due to the further rising fuel pressure, the control member and the valve member resumes moving and opening of the injector occurs at a speed that is determined by the stiffness of said spring.

The inner nut 113 may be moved vertically with respect to the main nut 101 in order to adjust the vertical location of the lower end 111 of the rod 110 by loosening and then tightening of the nut 115. Also, the compressive force of the spring 112 may be adjusted by raising or lowering the lower end of the rod 110 by releasing and tightening of the lock nuts 116 at the upper threaded end of the rod. Obviously, coordination of these two adjustments may permit one or both of the force of the spring the position of the lower end of the rod in a vertical direction to be changed as desired. As in the injector 20, nut 101 may be moved vertically in cap 80 to adjust the force of spring 100.

By the arrangement of the components of the injector 70, as above described, rotation of the valve member from the closed to the open position of the injector occur in two stages each at a fuel pressure and at a speed that may be determined to meet any of several different requirements of the injector. For instances, the spring 100 may have a low stiffness that permits the first stage of movement of the control member to occur at a relatively small increase of the fuel pressure with the result that the distance the control member has to move in this stage may be relatively long, which in turn permits a relatively small angle between the slope of the slot and the longitudinal axis of control member and corresponding low transmission of force between pin and slot. As the control member again starts moving after its temporary stop and build up of the fuel pressure, the opening of the orifices to full size may occur quickly at a relatively small increase of the fuel pressure by having a spring 112 with low stiffness. However, the opening of the orifices may occur so their size is increasing or decreasing in direct relation to increasing or decreasing fuel pressure by having a spring 112 that is accordingly stiff. As a result a fine atomization of the fuel will be ensured from the beginning to the end of an injection event.

The embodiment of the injector shown in FIGS. 11 to 13, and indicated in its entirety in FIG. 11 by reference character 120, is similar in many respects to the injectors 20 and 70, the primary difference between them residing in the fact that injector 120 is adapted to inject fuel in stages—e.g., a pilot injection followed by a main injection. Thus, as shown in FIG. 11, injector 120 includes an outer body 122 having flanges which permit its lower end 121 to be mounted on the head of an internal combustion engine, and thus, as in the case of injector 70, with the lower end of a nozzle 123 of an inner portion of the injector extending into a combustion chamber above a piston within a cylinder of the engine. Still further, and as in the case of the prior embodiments of the invention, the inner portion of injector 120 also includes a tubular member 124 which fits closely within a diametrically enlarged portion of a cavity 125 in the outer body of the injector. The flanged upper end of the nozzle of the body is seated upon an annular shoulder 126 at the lower end of the enlarged diameter portion of the cavity, and the lower end of the tubular member is held down upon the flanged upper end of the nozzle by means of a removable cap (not shown) of the outer body of the injector, as in the case of the prior embodiments.

Similarly, the inner portion of the injector includes a control sleeve 127 which is sealably slidable within the inner diameter of tubular member 124 as it reciprocates longitudinally with respect thereto, and which surrounds the upper enlarged portion (not shown) of a valve member so as to seal therebetween during relative longitudinal rotation between the valve member and the control sleeve as the valve member is rotated by the sleeve. As shown in FIG. 11, the upper portion of the valve member is connected by a reduced intermediate portion to a lower portion 128 which fits closely within the hollow nozzle 123. Again, as in the prior embodiments of the invention, the lower valve portion 128 has an opening (not shown) extending longitudinally thereof to connect ports 129 at its upper end with outlets 130 in its lower end which conforms to a conically shaped seat 132 at the lower end of the nozzle. The nozzle also have outlets 133 in its seat which are adapted to move into and out of register with outlets 130 in order to open or close the injector, as will be described to follow.

Fuel which is supplied to the cavity within the inner injector portion is effective over portions of the control sleeve and valve member in order to urge them upwardly, as shown and described in connection with the prior embodiments. Also, the valve member is spring-pressed downwardly to urge its lower end into tight engagement with the seat at the lower end of the nozzle, and thereby prevent unwanted leakage of fuel and the control member 127 is yieldably urged downwardly to its lowermost position wherein, as shown in FIG. 11, in which its lower end is supported upon the upper flanged end of the nozzle 123. Thus, with the exception noted below, the valve member and control sleeve are of the same construction and cooperate as in the injectors 20 and 70 wherein the control sleeve is also held against rotation, but is free to reciprocate in a longitudinal direction, while the valve member is free to be rotated in response to raising and lowering of the control member.

The upper end of the inner portion of the injector 120 is preferably constructed in a manner described in connection with the injector 70. That is, it includes a rod having a lower end which is spring-pressed into a position for engaging and temporarily stopping upward movement of the sleeve. However, the cooperation of the rod with the orifices of injector 120 has added significance insofar as the injector event is concerned, as will be explained in detail to follow.

As shown, the outlets 130 in the valve member are arranged in a pair of radially spaced-apart sets, the radially inner set being circumferentially displaced in a counterclockwise direction (as shown in FIGS. 11A, 12 and 13) with respect to the outer set, so that with rotation of the valve member to its open position in a counterclockwise direction, (as seen looking upwardly in FIGS. 11A, 12 and 13), the inner set leads the outer set. There are of course also a pair of sets of outlets 131 in the nozzle, the inner set being disposed on the same radius as the inner set of the valve member outlets, and the outer set being arranged on the same radius as the second set of outlets of the valve member. However, the two sets of outlets 131 in the nozzle are radially aligned, and thus neither leads nor trails the other.

As shown in FIGS. 11 and 13, the outlets 130 in the valve member are out of register with the outlets 131 in the nozzle so as to close the injector until fuel pressure reaches a level at which the control sleeve is raised to rotate the valve member in a clockwise direction (looking down in FIG. 11 but counterclockwise looking up in FIG. 11A) responsive to increasing fuel pressure in the cavity of the inner body of the injector.

As shown in FIG. 11, a slot 134 is formed in the inner diameter of the control sleeve so as to receive diametrically opposed pins 135 on the upper portion of the valve member. More particularly, there are four groups of inner and outer sets of outlets, spaced 90° from each other, and the slot is circumferentially continuous and made up of eight alternately inclined slot segments each extending about 45° of the circumference of the control sleeve.

As shown in FIG. 11, the peaks at the intersection of the upper sides of the slot segments are circumferentially offset a slight distance in a clockwise direction with respect to the peaks at the intersection of the lower sides thereof. Thus, as the control sleeve begins to move upwardly from the position of FIG. 11, the lower sides of the slot will engage the lower ends of the pins 135 to the right side of the vertical centerline of the pin to insure that, during continued upward movement of the sleeve and consequent rotation of the valve member, the valve member will be caused to rotate in a clockwise direction. In like manner, the intersection of the lower sides of the slots at the valleys are offset in a clockwise direction with respect to the upper sides of the slots at the valleys, so that, upon downward movement of the control sleeve, the upper side of the slot will engage the upper sides of the pins to the upper left, to continue to rotate the valve member in a clockwise direction during closing of the injector.

As shown in FIG. 13, when the valve member is closed the outer outlets 130 are essentially circumferentially intermediate the outer outlets 131, and the inner outlets 130 trail the inner outlets 131 by about 30°. Thus, as shown in FIG. 11A, after about 30° of clockwise rotation of the valve member, the outer outlets are still out of register, but the inner outlets of the valve member are caused to fully register with those of the nozzle. During subsequent valve member rotation of about 15°, to the position of FIG. 12, the inner outlets are moved out of register and the outer are moved into register. In this manner an initial pilot injection of fuel into the combustion chamber through orifices formed by the inner outlets of valve member and nozzle will be followed by a main injection through the orifices formed by the outer outlets of valve member and nozzle. Also, the previously described spring-pressed rod is so arranged that it engages and thus temporarily stops upward movement of the control sleeve as the inner set of outlets begin to register, whereby by adjustment of the spring, the duration of the pilot injection may be controlled. When the force of the spring is overcome by the increasing fuel pressure, the control sleeve will continue to move upwardly and the valve member will continue to rotate until the pins 135 in the valve member move into a valley of the slot 134 and the outer outlets are in register so that the main injection event occurs, as shown in FIG. 12.

As fuel pressure begins to decrease, the control sleeve will begin to move downwardly so as to bring the upper side of the slots 134 into engagement with the upper side of the pins 135 of the valve member and the pins of the valve member will begin to move upwardly into peaks of the slot. During this 45 degrees of rotation of the valve member, the outlets in the valve member will move a corresponding distance in a counterclockwise direction from the position of FIG. 12 to that of FIG. 13. During this time, neither set of outlets are brought into register with one another so that, during movement of the valve member to injector closing position, there is no unwanted late injection of fuel into the combustion chamber.

The parameters of the three types of injectors, which are illustrated in FIGS. 14 to 16, include orifice size, valve member movement or valve member/control member movement and fuel pressure, each as a function of time, and more specifically as a function of the injection duration of the injection event. The parameters shown in FIG. 14 are those which are typical of a conventional injector of the type first described in this application, the parameters illustrated in FIG. 15 are typical of an injector constructed in accordance with the first-described embodiment of this invention, and the parameters illustrated in FIG. 16 are typical of an injector constructed in accordance with the second-described embodiment of the invention. A comparison of these Figures illustrates the fact that while fuel pressure at the closing of the conventional injector is relatively low and less than that during opening, fuel pressure at closing of injectors constructed in accordance with the present invention is relatively high and equal to or greater than that at opening. As well known in the art, this relationship of fuel pressure at closing to that at opening is of particular advantage in the efficiency of the injection event.

As illustrated in FIG. 14, and as previously described, the orifices in the lower end of the nozzle of the conventional injector are of fixed size during the entire injection event. As also illustrated in this Figure, the valve member first begins to move upwardly to open the orifices of the injector, when fuel pressure has reached the level A, and when fuel pressure has reached the level B, the valve member has moved upwardly the maximum amount. As the fuel pressure decreases, and because of the resistance of gas pressure in the combustion chamber, the valve member will not begin to move downwardly until fuel pressure drops to the level C, which is lower than the level A at which the valve member first moved upwardly to open the injector. Fuel pressure then continues to drop to the level D, at which time the valve member has moved to its lowermost position to close the orifices and thus close the injector.

As fuel is supplied to the first embodiment of the injector of the present invention through a constant pressure source controlled by a separate fuel valve, it will reach a pressure level E, before the control sleeve begins to move upwardly. As fuel pressure continues to rise to level F, the control sleeve is further raised to lift the slots therein into engagement with the pins on the rotatable valve member. As previously described, and as indicated by a short flat segment of intermediate curve of FIG. 15, the control sleeve is temporarily stopped at this point as fuel pressure continues to rise from the level F to the level G. Upon further rise in fuel pressure from the level G, the control sleeve is moved upwardly with a snap action at a rapid pace so as to quickly move to its uppermost position, and thus quickly rotate the valve member to a position in which the orifices with maximum size are formed by the outlets of the valve member and the nozzle.

As fuel pressure begins to decrease in the injector of the first embodiment of the invention, to the level shown at H, the control sleeve will move downwardly until pins 61 engage the top sides of the slot 60, and then temporarily stop, as illustrated by the short flat segment of the intermediate curve, until the fuel pressure decreases further to the level J. As the fuel pressure continues to drop to level K, the valve member will again be moved with a snap action and thus at a fast rate to close the injector. As previously indicated, the fuel pressure at closing, as indicated by the level K, is not only relatively high, but in fact is higher than fuel pressure at the level G upon opening of the injector.

In the case of the second-described embodiment of the injector of the present invention, the rising fuel pressure, which may be supplied by a conventional displacement pump, will reach the level L before overcoming the force of the spring that urges the control member downwardly, and then move the control member upwardly to the position in which it is engaged with the spring biased rod 110 when fuel pressure is at level M. In this position the control member is temporarily stopped until the fuel pressure rises above the level N whereupon the control member is moved at a rate that corresponds to that of the rising fuel pressure. Thus the orifices of the injector are opened at a corresponding rate to maximum size as the fuel pressure rises to its peak level. As the fuel pressure then drops, movement of the control member and thus closing of the injector will not begin until the fuel pressure drops below level 0 because of resisting frictional forces. However, the following downwardly movement of the control member will occur quickly by snap action and the orifices of the injector are closed when the dropping fuel pressure reaches the level P.

As compared with FIG. 14, FIGS. 15 and 16 illustrate the superiority of the present invention by showing an important feature —i.e., that the fuel spray from the injector at the end of an injection event is cut off by orifices that are closing at a fuel pressure high enough to ensure a good atomization. Atomization is further enhanced because, when closing, the diminishing orifices are getting a shape —i.e., a narrow area encompassed by parts of two circles —that causes increased turbulence. As is earlier described, the injector is not burdened by unwanted leakage of fuel.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A fuel injector, comprising a valve body having a cavity extending longitudinally therein, an inlet through which fuel may be supplied to the cavity, a valve seat at one end of the cavity, and a plurality of circumferentially spaced outlets which connect the seat with the exterior of the valve body for injecting fuel into a cylinder of an internal combustion engine, a valve member extending longitudinally within the cavity and having an end surface facing and conforming to the valve seat, said valve member having an opening therein which connects with the cavity, and circumferentially spaced outlets which connect the opening with the end surface of the valve member, means yieldably urging the end surface of the valve member against the valve seat, and means responsive to rising fuel pressure in the cavity for rotating the valve member from a position in which the outlets in the valve member are out of register with the outlets of the valve body to a position in which the outlets of the valve member and valve body are in register, and to decreasing fuel pressure in the cavity for rotating the valve member from the position in which the outlets in the valve member are in register with the outlets of the valve body to a position in which the outlets in the valve member are out of register with the outlets in the valve body.

2. A fuel injector of the character defined in claim 1, including means urging the end surface of the valve member away from the valve seat in response to fuel pressure in the cavity.

3. A fuel injector of the character defined in claim 1, including means for stopping rotation of the valve member toward its position in which the outlets in the valve member and valve body are in register, and means for adjusting the stopping means to determine the position in which the valve member is stopped and thus the extent to which the outlets are brought into register.

4. A fuel injector, comprising a valve body having a cavity extending longitudinally therein and including a nozzle adapted to extend into a cylinder of an internal combustion engine, an inlet through which fuel may be supplied to the nozzle, a valve seat at one end of the nozzle, and a plurality of circumferentially spaced outlets in the seat, a valve member extending longitudinally within the cavity and having an end facing and conforming to the valve seat, an opening which connects with the cavity, and circumferentially spaced outlets in the end of the valve member, means yieldably urging the end surface of the valve member against the valve seat, a control member mounted within the valve body cavity for longitudinal movement with respect thereto, and having means thereon for urging it in one longitudinal direction in response to fuel pressure in the cavity, means yieldably urging the control member in the opposite longitudinal direction, and means connecting the control member to the valve member for rotating the valve member from a position in which the outlets in the valve member and valve body are out of register to a position in which the outlets are in register, upon movement of the control member in one longitudinal direction in response to rising fuel pressure in the cavity, and from the position in which the outlets in the valve member and valve body are in register to a postion in which they are out of register, upon movement of the control member in the other longitudinal direction in response to decreasing fuel pressure in the cavity.

5. A fuel injector of the character defined in claim 4, wherein the valve member has means thereon urging its end surface away from the valve seat in response to fuel pressure in the cavity.

6. A fuel injector of the character defined in claim 5, wherein the control member is moved a short distance in said one longitudinal direction prior to connection to said valve member and short distance in said other longitudinal direction following disconnection from said valve member.

7. A fuel injector of the character defined in claim 4, wherein the connecting means includes means for rotating the valve member successively at different rates per unit of longitudinal movement of the control member.

8. A fuel injector of the character defined in claim 7, wherein the valve member is initially rotated at one rate and thereafter at another rate.

9. A fuel injector of the character defined in claim 8, wherein the valve member is initially rotated at a relatively fast rate until the outlets in the valve member and valve body first move into register, and then at a relatively slow rate as they move into full register.

10. A fuel injector of the character defined in claim 4, wherein the outlets in the valve member and valve body include a radially inner set and a radially outer set which are so arranged that the inner set moves into and out of register prior to the outer set.

11. A fuel injector of the character defined in claim 10, including means for temporarily stopping rotation of the valve member as the inner set is moved into register and until fuel pressure builds up, and then permitting continued rotation thereof to move the outer set into register.

12. A fuel injector of the character defined in claim 4, including means for temporarily stopping rotation of the valve member as the outlets are first moved partly toward but not into register and until pressure builds up and then permitting continued rotation of the valve member.

13. A fuel injector of the character defined in claim 4, including means for stopping rotation of the valve member toward its position in which the outlets therein are in register with those of the valve body, and means for adjusting the stopping means to determine the position in which the valve member is stopped and thus the extent to which the outlets are brought into register.

14. A fuel injector, comprising a valve body having a cavity extending longitudinally therein, and including a nozzle adapted to extend into a cylinder of an internal combustion engine, an inlet through which fuel may be supplied to the nozzle, a valve seat at one end of the nozzle, and a plurality of circumferentially spaced outlets in the valve seat, a valve member extending longitudinally within the cavity and having an end surface facing and conforming to the valve seat, an opening which connects with the cavity, and circumferentially spaced outlets in the end of the valve member, spring means yieldably urging the end of the valve member against the valve seat, a control sleeve mounted within the body for longitudinal movement with respect thereto in surrounding relation to the valve member, and having means thereon which is responsive to fuel pressure in the cavity for urging the control sleeve in a longitudinal direction away from the seat, spring means yieldably urging the control sleeve in the opposite longitudinal direction, one of said valve member and control sleeve having a slot therein, and the other of said valve member and control sleeve having a pin slidable in the slot, said slot being arranged to rotate the valve member from a position in which the outlets in the valve member and valve body are out of register to a position in which the outlets are in register, upon movement of the sleeve in one longitudinal direction in response to rising fuel pressure in the cavity, and from the position in which the outlets in the valve member and valve body are in register to a position in which they are out of register therewith, upon movement of the sleeve in the other longitudinal direction in response to decreasing fuel pressure in the cavity.

15. A fuel injector of the character defined in claim 14, wherein the valve member has means thereon which is responsive to fuel pressure in the cavity to urge the end surface of the valve member away from the seat.

16. A fuel injector of the character defined in claim 15, whrein there is lost movement between the pin and slot so that the control sleeve is moved a short distance in said one longitudinal direction prior to engagement of the slot and pin, and a corresponding distance in said other longitudinal direction following disengagement of the slot and pin.

17. A fuel injector of the character defined in claim 14, wherein the slot has portions which form different angles with respect to the longitudinal axis of the valve member so as to rotate the valve member at successively different rates per unit of longitudinal movement of the control sleeve.

18. A fuel injector of the character defined in claim 17, wherein one portion of the slot forms a relatively large angle so that the valve member is initially rotated at a relatively fast rate until the outlets first move into register, and a second portion forms a relatively small angle so as to continue to rotate the valve member at a relatively slow rate.

19. A fuel injector of the character defined in claim 14, wherein the outlets in the valve member and valve body include a radially inner set and a radially outer set which are so arranged that the one set moves into register prior to the other set.

20. A fuel injector of the character defined in claim 19, including a yieldable stop part engageable with the sleeve to temporarily stop rotation of the valve member as one set of outlets are moved into register, and until fuel pressure builds up, and then permit continued rotation thereof to move the other set of outlets into register.

21. A fuel injector of the character defined in claim 14, including stop means for engagement with the sleeve, upon longitudinal movement in said one direction, in order to stop rotation of the valve member, and means for adjusting the longitudinal position of the stop means to determine the location in which the sleeve is stopped and thus the extent to which the outlets are brought into register.

* * * * *